United States Patent [19]

Malzacher

[11] 4,348,007

[45] Sep. 7, 1982

[54] GRIPPER SYSTEM FOR MOVING DRILLING RIGS

[76] Inventor: Fred Malzacher, 1555 Callens Rd., Ventura, Calif. 93003

[21] Appl. No.: 194,755

[22] Filed: Oct. 7, 1980

[51] Int. Cl.[3] ..... B66F 1/00

[52] U.S. Cl. ..... 254/106

[58] Field of Search ..... 24/263 B, 263 R; 294/86.3, 101, 116; 269/229, 231, 235, 236, 204; 254/105-107, 29 R, 35-37

[56] References Cited

U.S. PATENT DOCUMENTS

| | | | |
|---|---|---|---|
| 2,422,865 | 6/1947 | Tucker | 24/263 B |
| 2,581,040 | 1/1952 | Mullenbach | 269/235 X |
| 2,607,058 | 8/1952 | Fergusen | 24/263 B |
| 2,620,693 | 12/1952 | Eslich | 269/229 X |
| 3,373,971 | 3/1968 | Chambers et al. | 254/107 |
| 3,464,095 | 9/1969 | Chambers | 254/107 |
| 3,559,954 | 2/1971 | Chambers et al. | 254/106 |
| 4,239,198 | 12/1980 | Trupp | 269/204 |

*Primary Examiner*—Robert C. Watson
*Attorney, Agent, or Firm*—David O'Reilly

[57] ABSTRACT

A gripper system for moving drilling rigs on offshore drilling platforms supported on flanged skid bases having a pair of side plates with flanges for engaging the underside of the skid base flange. The side plates are supported on a pair of rotatable shafts, having eccentric cam surfaces for engaging the upper surface of the skid base flanges. Each shaft is independently rotated and clamped by an hydraulically operated cam locking actuator adapted to rotate the respective shaft and eccentric cam surfaces. The side plates are bolted to a main frame, also supported on the rotatable shafts with the bolts acting as pivot pins for attaching a hydraulic jack means between the gripper assembly and the drilling rig to be moved. The drilling rig is moved by successive clamping and releasing of the cam locking gripper assembly and operation of the hydraulic skid jack means.

10 Claims, 8 Drawing Figures

GRIPPER SYSTEM FOR MOVING DRILLING RIGS

BACKGROUND OF THE INVENTION

This invention relates to a gripper system, and more particularly, relates to a gripper system for moving drilling rigs supported on flanged skid bases of an offshore drilling platform.

Offshore drilling platforms are used to drill a number of holes. That is, a single platform may be used to drill or sink numerous wells, sometimes as many as twenty or more from the same platform. Thus, each time a well is sunk, the drilling rig must be repositioned for drilling in a different area or at a different angle. The drilling rig is mounted on flanged skid bases to permit sliding the rig from position to position for drilling successive wells. Previously, a cumbersome and time-consuming mechanical block-and-tackle jacking system was used to move the drilling rig, or slots were cut in the skid beams for use with slide frogs to move the drilling rig. It would be preferable if such movement of the drilling rig could be automated to considerably reduce the time and efficiency for moving the drilling rig from one position to another on the drilling platform. Further, cutting slots in skid base is a costly and time consuming fabrication process.

SUMMARY

The purpose of the present invention is to provide an hydraulically operated gripper system which can be used to move a drilling rig about on an offshore drilling platform in an efficient step-wise fashion.

The present invention is comprised of a gripper assembly and hydraulically operated means, resting on a flanged skid base which supports a drilling rig. This invention is an improvement to the gripper assembly disclosed and described in U.S. patent application Ser. No. 138,329 by Apr. 8, 1980, incorporated herein by reference, by the same inventor as the invention disclosed herein. The gripper assembly has side plates with flanges for engaging the underside of the flanges of the skid base. The side plates are mounted on rotatable shafts having eccentric cam surfaces for engaging the upper surface of the skid base. Rotation of the shaft clamps the flanges of the skid base between the eccentric cam surfaces and the flanges on the side plates. A main frame is pinned or bolted to the side plates to provide structural strength with the bolts acting as pivot pins for attachment of a hydraulic jack to move the drilling rig on the skid bases in a step-wise fashion.

The rotatable shafts having the eccentric cams are operated by hydraulic cam locking actuators or clamping cylinders which rotate the shafts to clamp the skid base flanges between the eccentric cams and the flange on the side plates. Preferably, the hydraulic cam locking actuators for operating the rotating shafts are on opposite sides of the gripper assembly, and are in opposing relationship. That is, the eccentric cams and the hydraulic actuators work against each other, such that any longitudinal force parallel to the axis of the skid base tends to increase the clamping force, preventing the gripper assembly from slipping.

The drilling rig is moved in a step-wise fashion by successively clamping and releasing the gripper assembly while operating the hydraulic jack. The gripper assembly is first clamped to the skid base and the hydraulic skidding jack cylinder is operated to push or pull the drilling rig on the skid base a length equal to the cylinder stroke after the gripper assembly has been clamped to the flange base. In practice, more than one gripper assembly will be used in a gripper system similar to that disclosed and described in the above-identified patent application by the same inventor as the invention disclosed herein. After the drilling rig has been moved a step, the gripper assembly is released and moved forward a step by retracting the push rod of the jack cylinder to the minimum length of the cylinder stroke. The gripper assembly is then reclamped on the skid base and the step-wise movement repeated.

The frame bolted to the side plates is provided with clevises through which the bolts may pass acting as pivot pins for attachment of a hydraulic skid jack. These hydraulic jack connecting clevises are provided at each end of the gripper assembly so that it can be used to push or pull in either direction without the necessity of completely removing the gripper assembly and turning it around. Thus, it can be used to move one or more drilling rigs mounted on skid bases on an offshore drilling platform. This system is substantially roughneck-resistant, saving the user down time and maintenance costs.

It is one object of the present invention to provide an easily operated gripper assembly for movement of drilling rigs on offshore drilling platforms which is virtually roughneck-resistant.

Another object of the present invention is to provide a gripper assembly designed to prevent slippage during use.

Another object of the present invention is to provide a gripper assembly having a rotatable eccentric cam surface for clamping skid bases.

Still another object of the present invention is to provide a gripper assembly having rotatable eccentric cam surfaces on rotatable shafts for rotation in opposite opposing directions for increasing clamping force when longitudinal force is applied to the gripper assembly.

These and other objects of the invention will become apparent from the following detailed description when considered in conjunction with the accompanying drawings wherein like reference numbers identify like parts throughout.

DESCRIPTION OF THE PREFERRED EMBODIMENT

Figure 1:
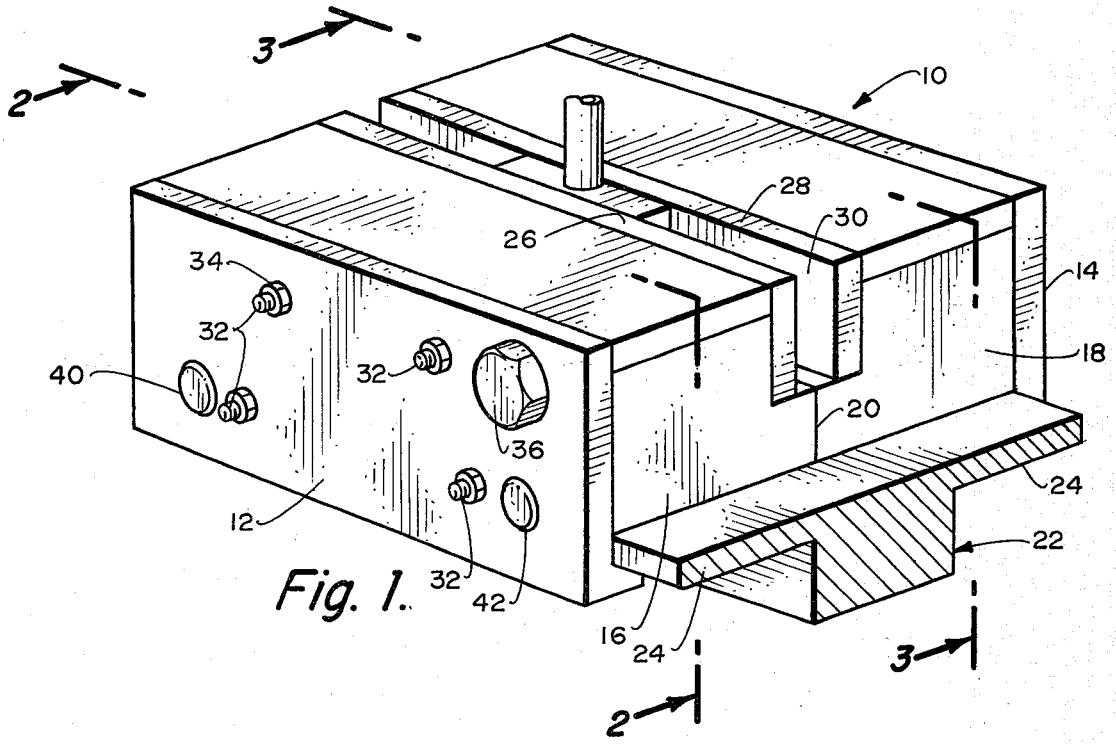
FIG. 1 is a perspective view of a gripper system according to the invention, mounted on a flanged skid base.

The gripper system of the present invention is generally shown in FIG. 1 at 10 and is comprised of a split housing having side plates 12 and 14 attached to a main frame comprised of center portions 16 and 18 which are split at 20. Having the house formed by main frame members 16 and 18 split at 20 facilitates installation of the gripper system on the flanges 24 of skid base 22. Each side 16 and 18, forming the main frame, has a longitudinal plate 26 and 28 forming a channel 30 for installation of a clevise for attachment of an hydraulic skidding jack, as shown and described in the above identified U.S. patent application. The two sides of the split housing are held together by a plurality of threaded rods 32, clamped by nuts 34. Additionally, bolts or pins 36 passing through the longitudinal plates 26 and 28, and secured by cotter pins or nuts 38, provide pivot pins for attachment of the hydraulic jacks.

Each pin 36 passes through from the opposite side through the channel 30 formed by the longitudinal plates 26 and 28. Thus, the gripper assembly 10 is attached to the skid base 22 by simply removing the rods 32 and the nuts 38, allowing the housing to separate.

Figure 2:
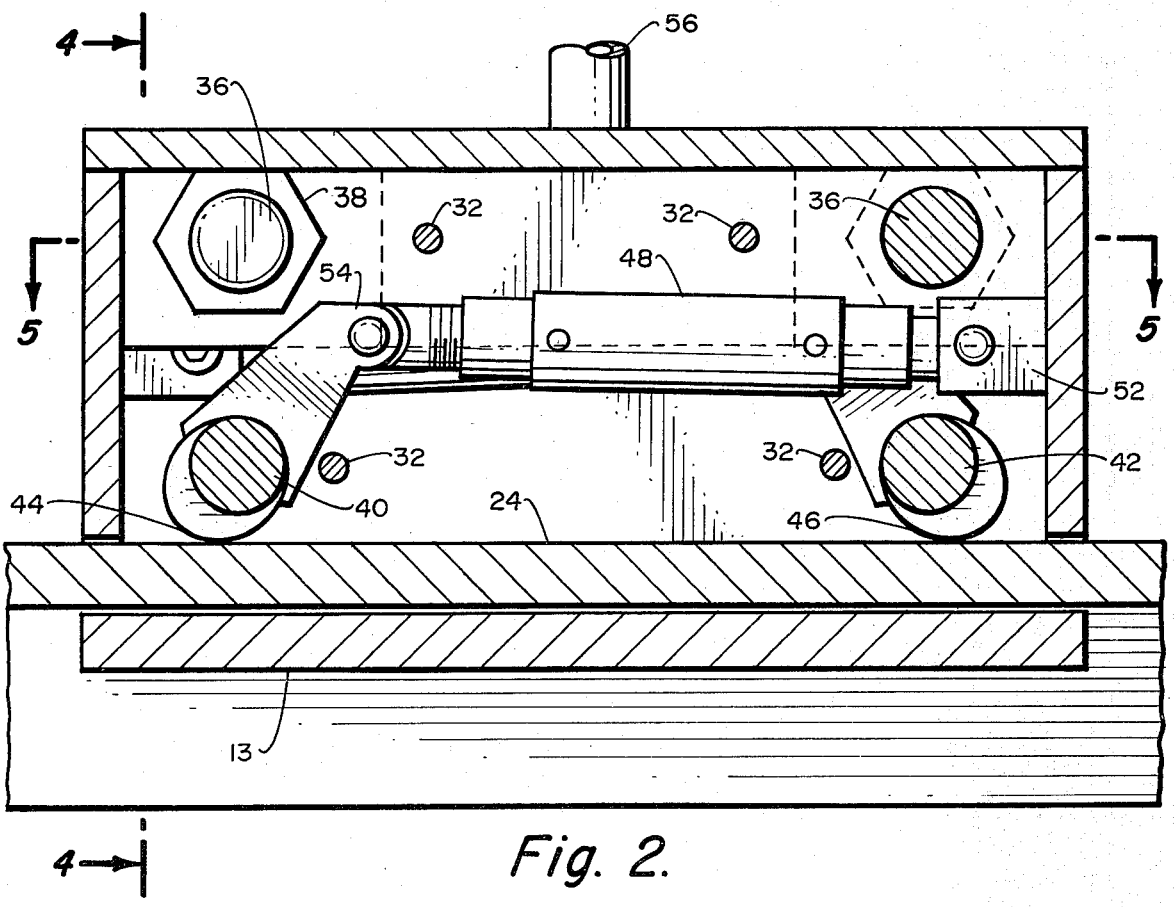
FIG. 2 is a sectional view of the gripper system taken at 2—2 of FIG. 1 in the unclamped position.

The clamping of the gripper assembly on the flanges 24 of the skid base 22 is accomplished, as can be seen in FIGS. 2–5. A pair of rotatable shafts 40 and 42 are provided, which pass through the entire gripper assembly and are supported by holes in the side plates 12 and 14. Each of the rotatable shafts, 40 and 42 has an eccentric cam 44 and 46 for clamping the gripper assembly on the skid base flanges 24. As can be seen in FIG. 2, the eccentric cam surfaces 44 and 46 are provided on opposite sides of the respective shafts 40 and 42 for applying opposing forces. In the unclamped position, the gripper assembly will rest on the eccentric cam surfaces 44 and 46, as shown. Preferably, each shaft would have eccentric cam surfaces on each end of the respective shafts, as shown at 44 in FIG. 4.

The flange 24 of the skid base 22 is clamped between the eccentric cam surfaces 44 and 46 of the shafts 40 and 42, and flanges 13 and 15 attach to the side plates 12 and 14. The flanges 13 and 15 grip the underside of the skid base flanges, while the eccentric surfaces clamp the upper surface.

The rotation of the shafts 40 and 42, and the respective cam surfaces 44 and 46, is accomplished by hydraulic cam lock positioning actuators or clamping cylinders 48 and 50. The hydraulic cam lock positioning actuator 48 is attached to a boss 52 at one end, and to an arm 54 affixed to the shaft 40 at the other end. The cam lock positioning actuators are connected through hydraulic hoses 56, 58 and 60. The hydraulic cam lock positioning actuator 50 on the opposite side of the gripper assembly is also connected to a boss 62 and to a lever arm 64 for simultaneous rotation of shaft 42 and eccentric cam 46.

The application of hydraulic power to the cam lock positioning actuators is similar with that shown and described in the above-identified patent application Ser. No. 138,329 incorporated herein by reference. An entire gripper system may include two or more gripper assemblies as disclosed therein.

The gripper system is operated as follows: Hydraulic pressure is simultaneously applied to cam locking actuators 48 and 50 through lines or hoses 56, 58 and 60. The respective cam locking actuators are simultaneously operated from a hydraulic control console (not shown) for rotation of the eccentric cam surfaces 44 and 46 from the position shown in FIG. 2 in the released (i.e., unclamped) position, with the gripping eccentric cam surfaces resting on the flanges 24. With the system in the clamped position as shown in FIG. 3, the flange 24 of the skid base 22 is clamped between the eccentric cam surfaces and the flanges 13 and 15 on the respective side plates which are raised to clamp against the under surface of flanges 24.

Figure 3:
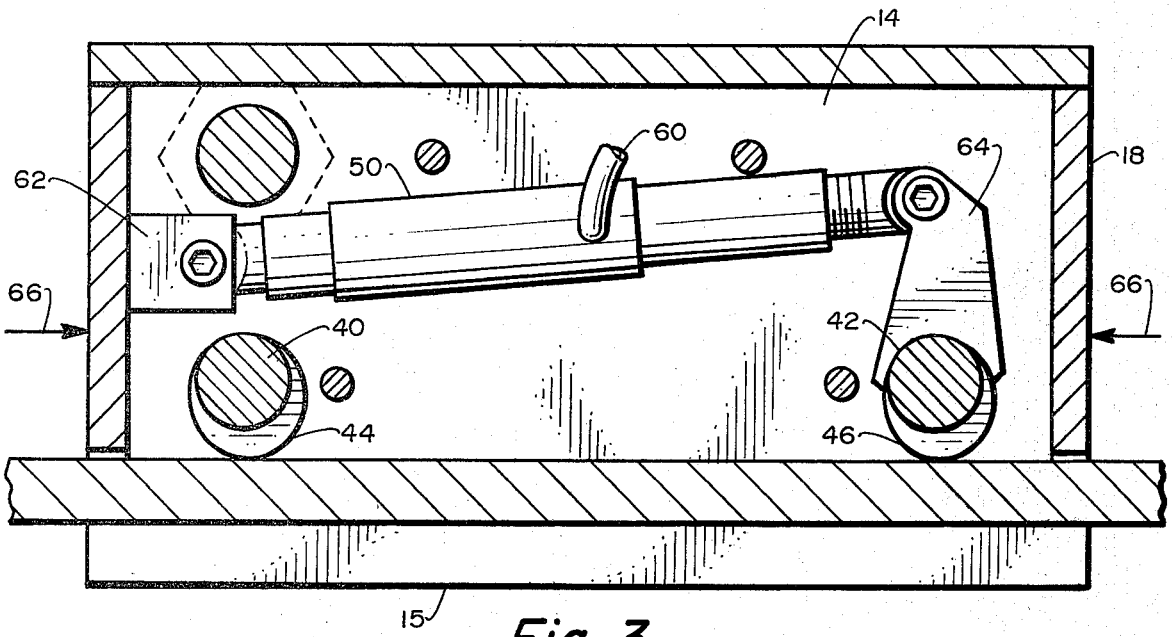
FIG. 3 is a sectional view taken at 3—3 of FIG. 1 illustrating clamped position.
Figure 4:
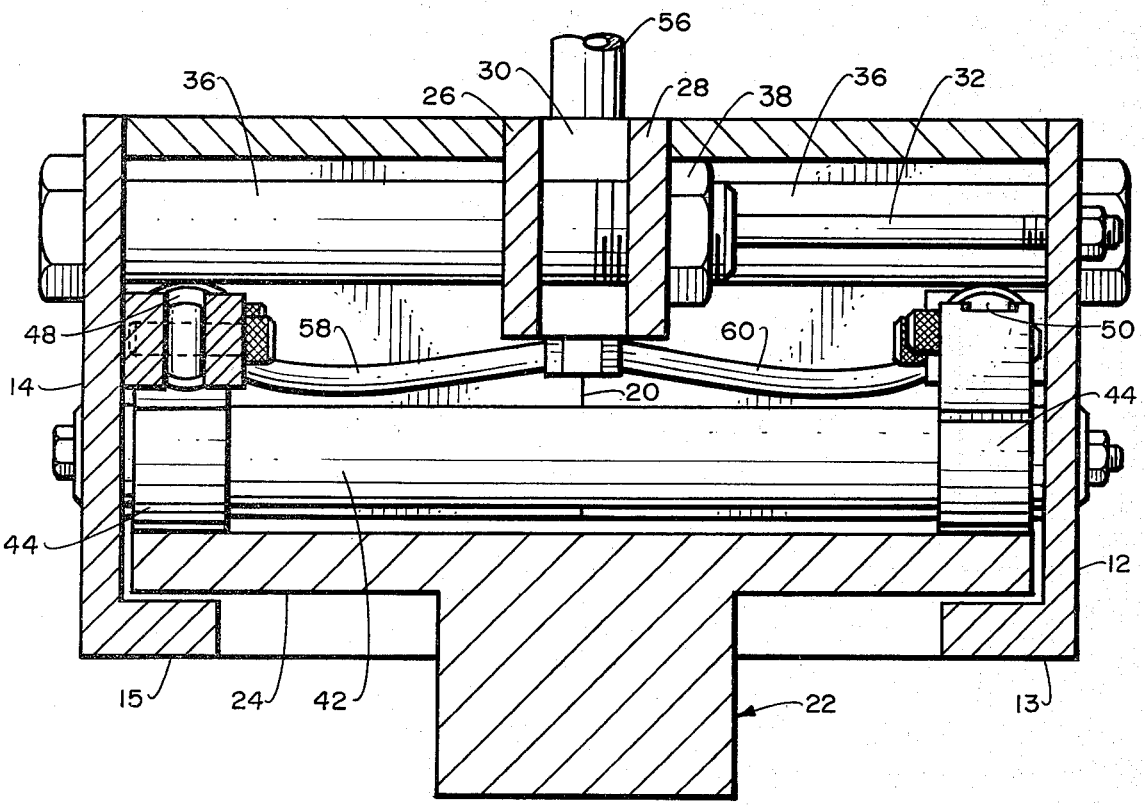
FIG. 4 is a sectional view of the gripper system taken at 4—4 of FIG. 2.
Figure 5:
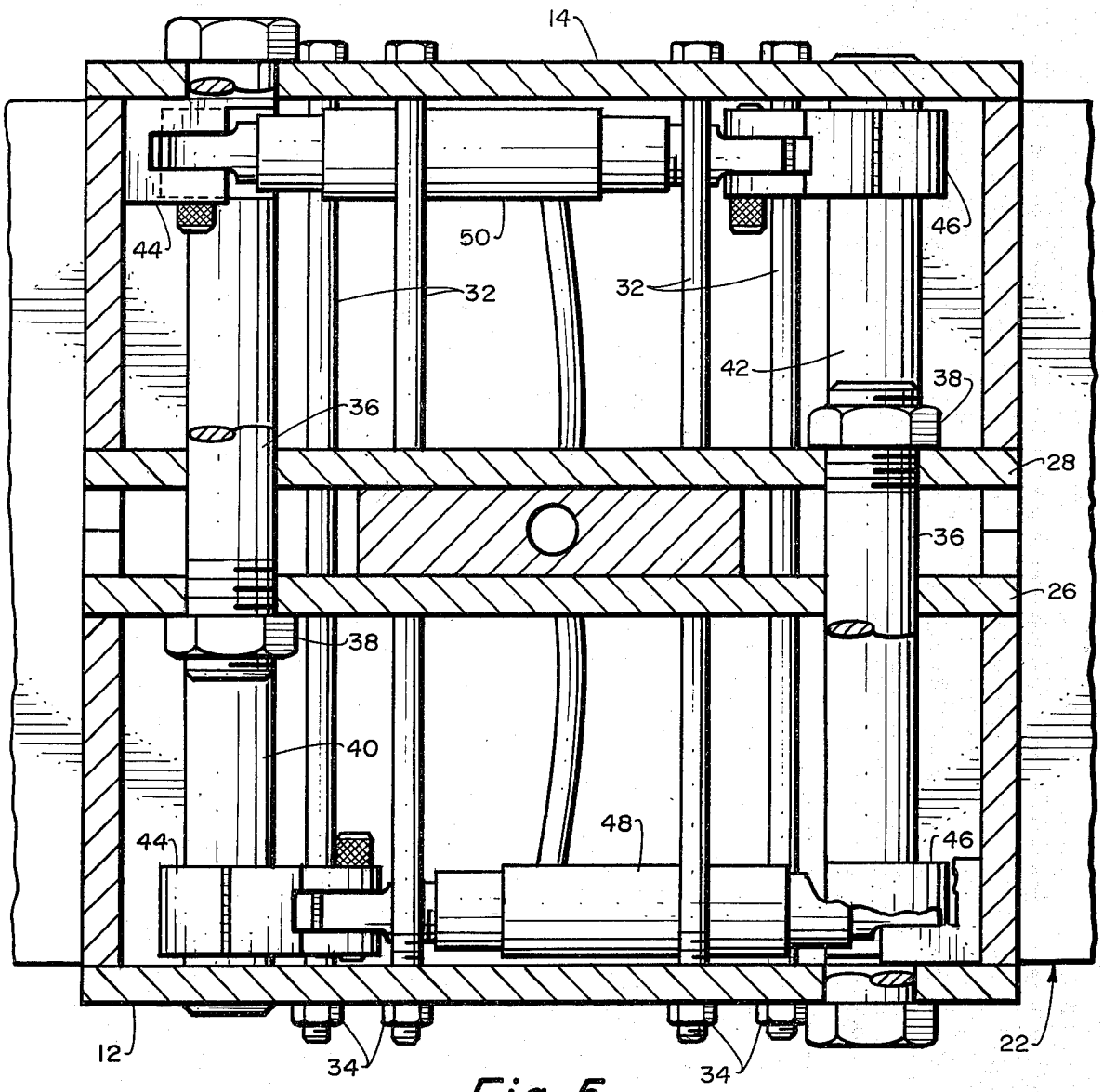
FIG. 5 is a sectional view of the gripper system taken at 5—5 of FIG. 2.

When the gripper assembly is securely clamped to the skid base as illustrated in FIG. 3, any longitudinal force in either direction, as indicated at arrows 66, tends to force the eccentric cam surface at the opposite end of the gripper assembly from the force into further clamping relationship on the flange 24 of the skid base. Thus, when moving a drilling rig, the respective forces tend to increase the clamping action, thus preventing slippage. One end of a hydraulic skidding jack is connected to the pivot pins 36 at the end passing between the longitudinal plates forming the channel 30, and at the other end to a saddle on the drill rig as shown in U.S. patent application Ser. No. 138,329.

Figure 6:
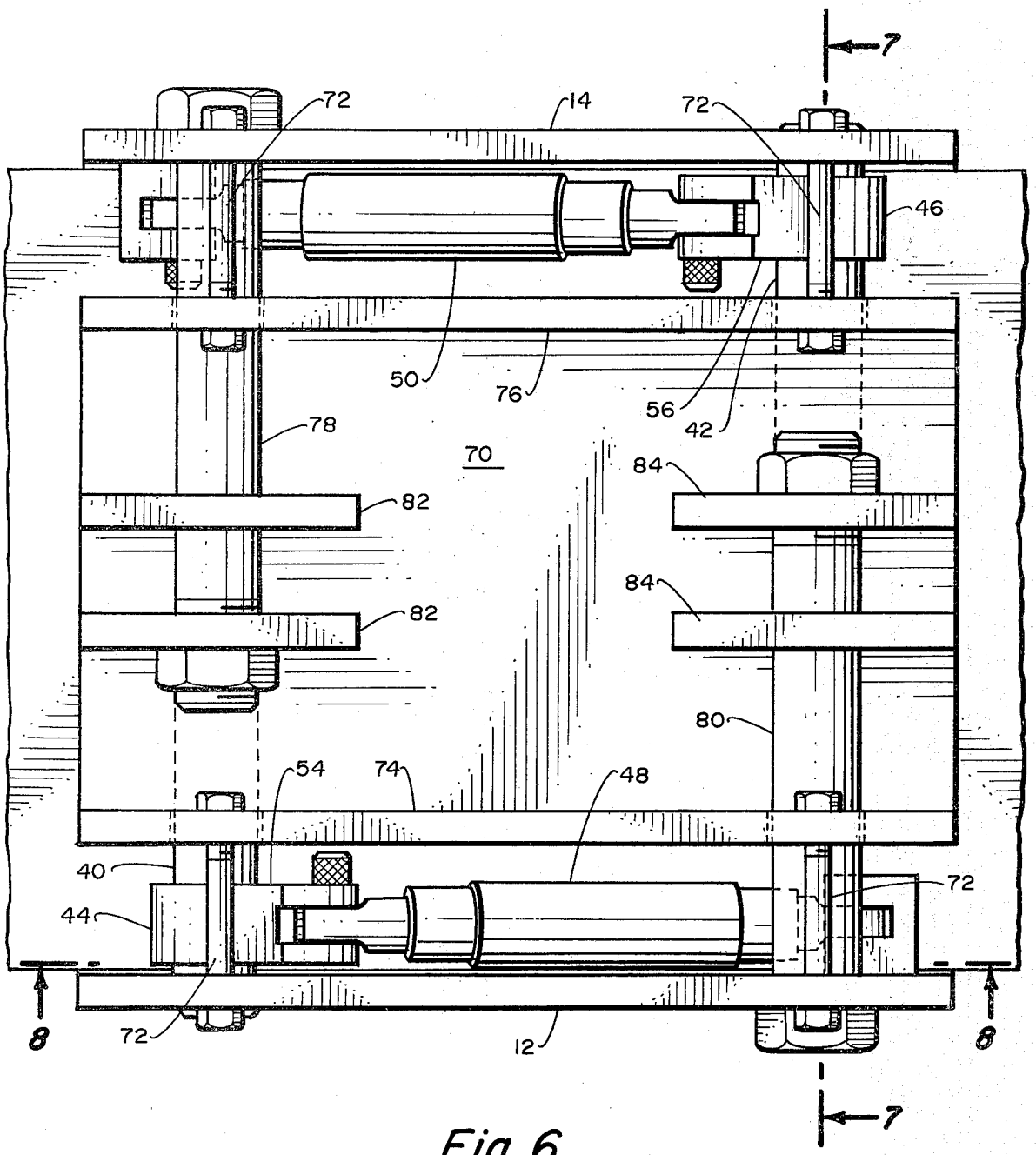
FIG. 6 is a top view of an alternate embodiment of the gripper system similar to the view shown in sectional view of FIG. 5.
Figure 7:
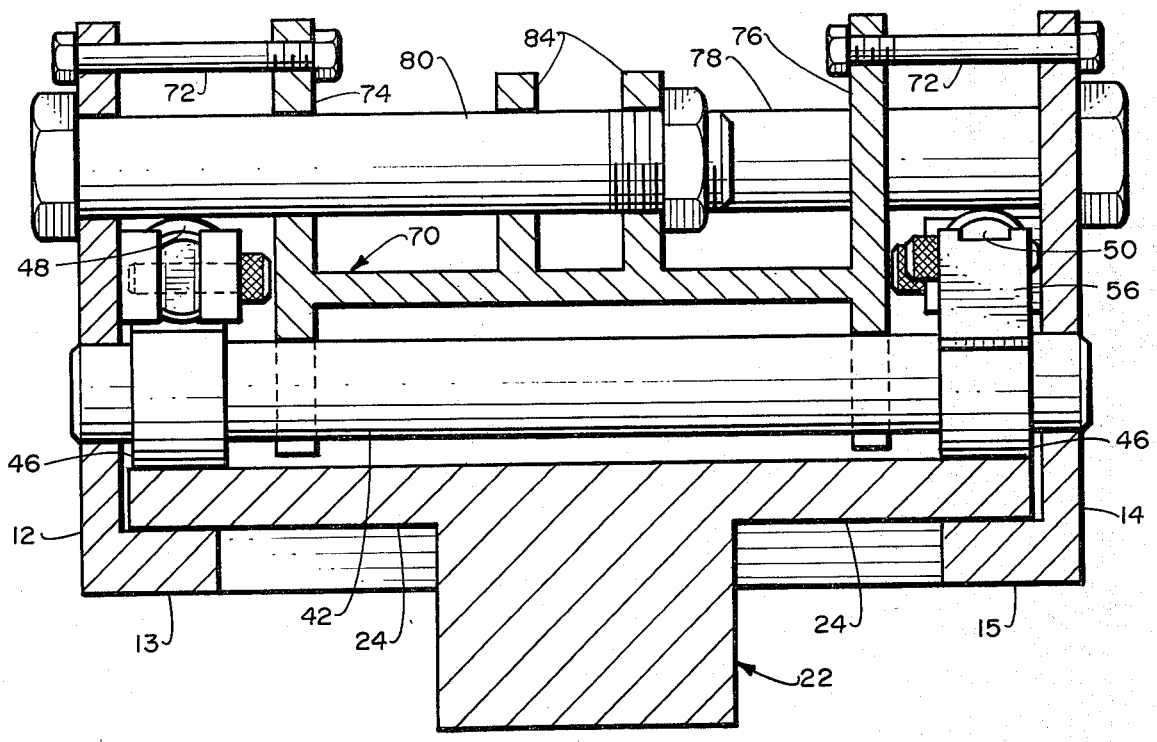
FIG. 7 is a sectional view of the gripper system taken at 7—7 of FIG. 6.
Figure 8:
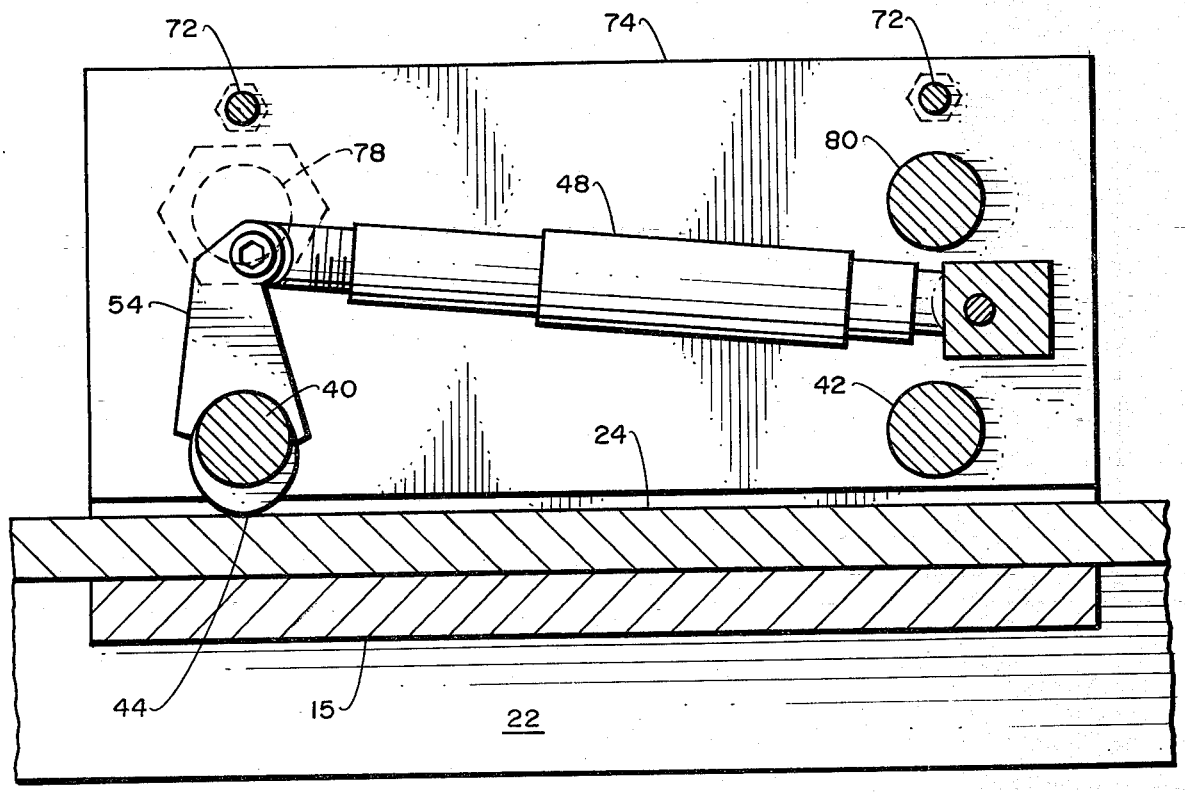
FIG. 8 is a sectional view of the gripper assembly of FIG. 6 taken at 8—8.

An alternate embodiment of the invention is illustrated in FIGS. 6–8 in which the side plates 12 and 14 are separated from a center frame assembly 70 supported on the rotatable shafts 40 and 42. Thus, the gripper assembly is a three-piece structure, comprised of side plates 12 and 14 as before, and a center frame assembly attached to the side plates by means of pins or bolts 72 secured to flanges 74 and 76 on the center frame assembly 70. As before, large pins or bolts 78 and 80 pass through the side plates 12 and 14 into clevise flanges 82 and 84 on each end of the center frame 70, acting as pivot pins for attachment of a hydraulic skidding jack. The center frame assembly 70 rests on the rotatable shafts 40 and 42 which engage U-shaped slots in the flanges 74 and 76.

The gripper assembly is operated in the same fashion as described with the embodiment of FIG. 1. Hydraulic hoses (not shown) are connected to operate the hydraulic cam lock positioning actuators 48 and 50 to rotate the eccentric cams on the shafts 40 and 42 against the upper surface of flanges 24 on the skid base 22 to raise flanges 13 and 15 so that the flange 24 is clamped between the flanges 13 and 15 on the side plates and the eccentric cams. A hydraulic skidding jack is then operated to move the drilling rig the length of its cylinder stroke, as previously described. The hydraulic gripper assembly is then released, and the hydraulic skidding jack retracted, moving the gripper assembly an amount equal to the hydraulic jack cylinder stroke for reclamping and moving the drilling rig another step.

Thus, there has been disclosed a gripper system for moving drilling rigs on offshore drilling platforms in which positive non-slipping clamping is provided for successive step-wise movement of the drilling rigs. The gripper assembly is simple in construction and easy to install and use.

Obviously, many modifications and variations of the invention are possible in light of the above teachings. It is therefore to be understood that the full scope of the invention is not limited to the details disclosed herein but only by the claims, and may be practiced otherwise than as specifically described.

What is claimed is:

1. A gripper system for moving drilling rigs supported on flanged skid bases of a drilling platform comprising;

clamping means for clamping the flanges of said skid base;

said clamping means include a pair of rotatable eccentric cam means;

hydraulic cam locking means for rotating and holding said eccentric cam means in clamping engagement with said flanges of said skid base;

said hydraulic cam locking means adapted to rotate said pair of eccentric cam means in opposite directions so that their clamping forces are in opposition;

hydraulic skidding jack means connecting said hydraulic cam locking means to a saddle of said drilling rig for moving said drilling rig while said hydraulic cam locking means is securely clamped to said skid base.

2. The gripper system according to claim 1 wherein said clamping means includes:

a pair of side plates;

said side plates having flanges for engaging the underside of said ski base flanges;

a pair of rotatable shaft means connecting said side plates;

said pair of rotatable eccentric cam means being attached to said shaft means for rotation therewith.

3. The gripper system according to claim 2 in which said pair of rotatable shaft means comprises:

a pair of rotatable shafts connected to the respective ends of said side plates.

4. The gripper system according to claim 3 in which each of said pair of shafts has at least one eccentric cam means.

5. The gripper system according to claim 4 in which the eccentric cam means is attached to each of said shafts whereby the clamping is effected by the opposite rotation of said shafts by said hydraulic cam locking means so that any force longitudinal to said skid base tends to increase the clamping force of said eccentric cam means.

6. The gripper system according to claim 2 in which said clamping means includes:

a housing spanning said skid base;

said side plates forming an integral part of said housing.

7. The gripper system according to claim 6 in which said housing comprises a split housing having transverse pin means holding said housing on said skid base.

8. The gripper system according to claim 7 in which said housing includes:

center support plate means, said pin means extending through said support plate means; said pin means acting as a pivot pin for attachment of said hydraulic skidding jack means.

9. The gripper system according to claim 2 in which said clamping means includes:

a center frame supported on said shaft means;

means for attaching said hydraulic skidding jack means to said center frame.

10. The gripper system according to claim 9 in which said means for attaching said hydraulic skidding jack means comprises a pivot pin passing through at least one of said side plates and said center frame.

* * * * *